United States Patent [19]

Diforte, Jr.

[11] 3,971,559

[45] July 27, 1976

[54] WEIGHTING DEVICE FOR ATTACHMENT TO BASEBALL BATS

[75] Inventor: Mariano P. Diforte, Jr., Baltimore, Md.

[73] Assignee: Bat Weight, Inc., Baltimore, Md.

[22] Filed: Aug. 23, 1974

[21] Appl. No.: 499,905

Related U.S. Application Data

[63] Continuation-in-part of Ser. No. 397,713, Sept. 17, 1973, abandoned.

[52] U.S. Cl. ..... 273/26 R; 273/94 B

[51] Int. Cl.[2] ..... A63B 69/40

[58] Field of Search ..... 273/26 R, 26 B, 193 R, 273/194 B, 72 R, 165, DIG. 5, DIG. 6; 9/345, 311, 328, 11 R, 11 A, 327, 307, 400, 1; 272/84, 81; 128/112, 113, 118, 120

[56] References Cited

UNITED STATES PATENTS

| | | | |
|---|---|---|---|
| 1,343,357 | 6/1920 | Eggers | 128/118 |
| 1,663,268 | 3/1928 | Foley et al. | 9/345 X |
| 2,978,375 | 4/1961 | Grawey | 273/DIG. 5 |
| 3,171,652 | 3/1965 | Newman | 272/84 |
| 3,231,271 | 1/1966 | Winer | 272/84 |
| 3,311,374 | 3/1967 | Wittenberg et al. | 272/84 |
| 3,334,899 | 8/1967 | Bosco et al. | 272/84 |
| 3,521,883 | 7/1970 | Hamilton | 273/26 R |
| 3,572,702 | 3/1971 | Dorn | 272/84 |
| 3,628,790 | 12/1971 | Gordon | 272/64 |
| 3,647,220 | 3/1972 | Burkart | 273/194 B |

*Primary Examiner*—Richard C. Pinkham
*Assistant Examiner*—T. Brown
*Attorney, Agent, or Firm*—Shlesinger, Arkwright, Garvey & Dinsmore

[57] ABSTRACT

This invention is a weighting device for attachment to baseball bats which is of generally doughnut shape, and comprising a hollow chamber adapted to be filled with liquid or granular weighting material, which device may be fitted over the handle of a baseball bat and frictionally engaged with the barrel thereof for the purpose of permitting the batter to take practice swings with a heavy bat prior to taking his turn at bat.

11 Claims, 7 Drawing Figures

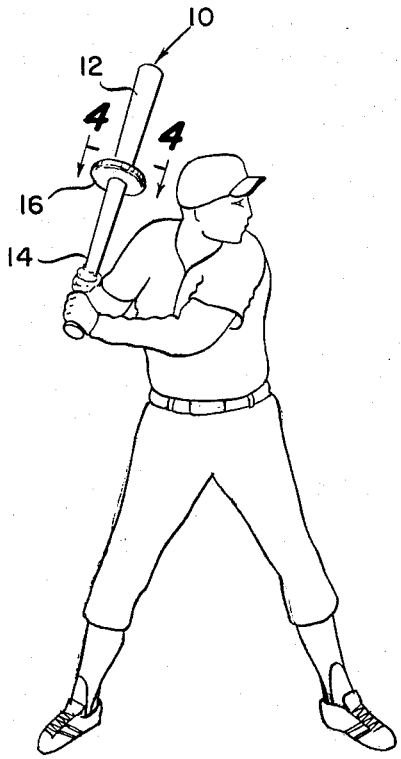
Fig. 1
Fig. 2
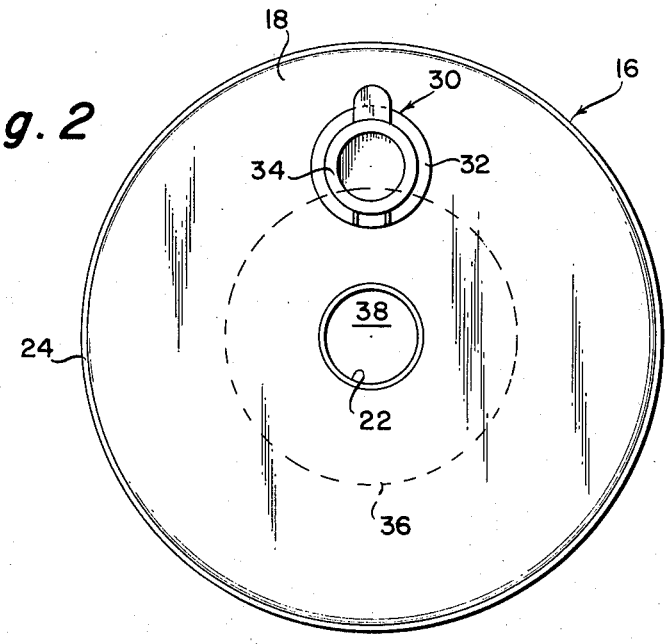
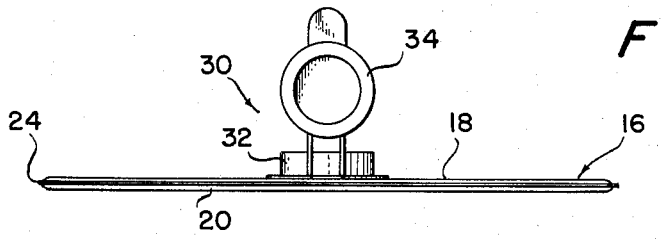
Fig. 3

Fig. 4
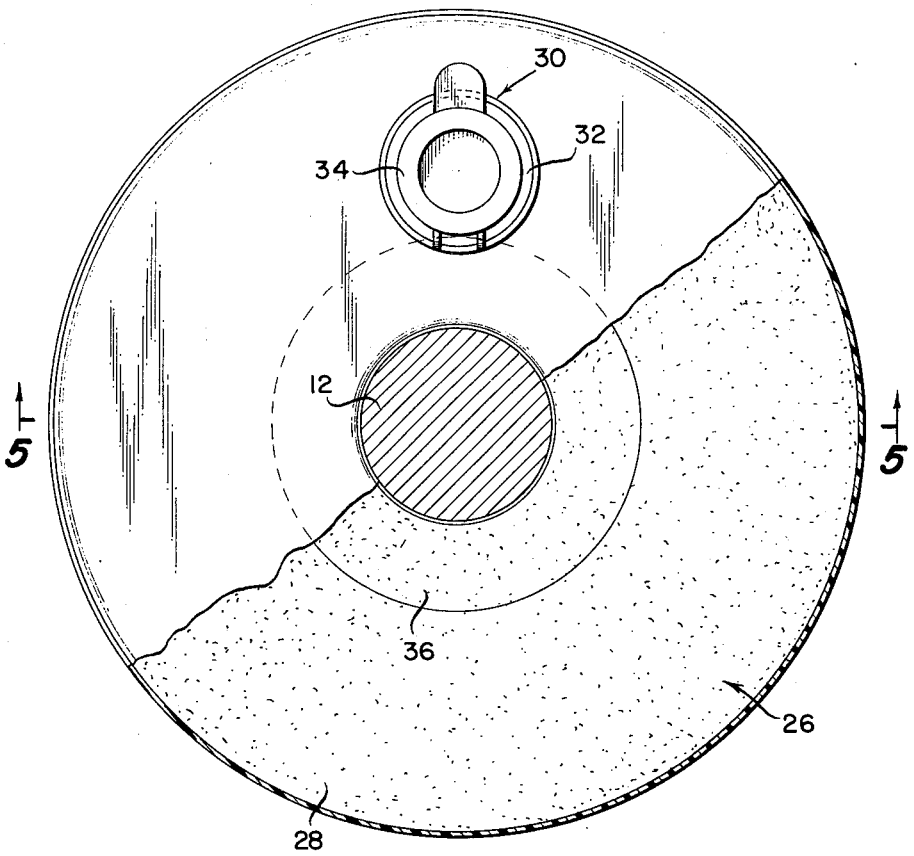
Fig. 5
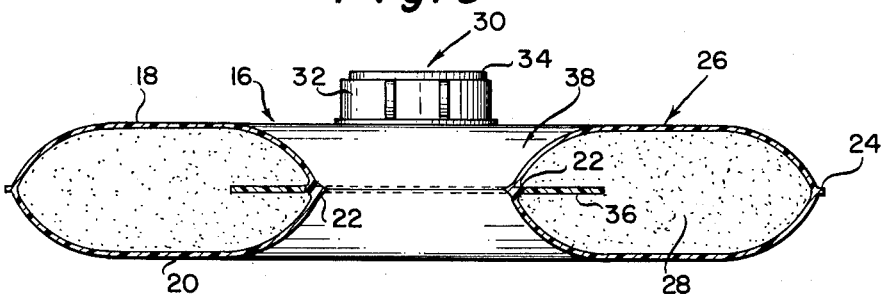
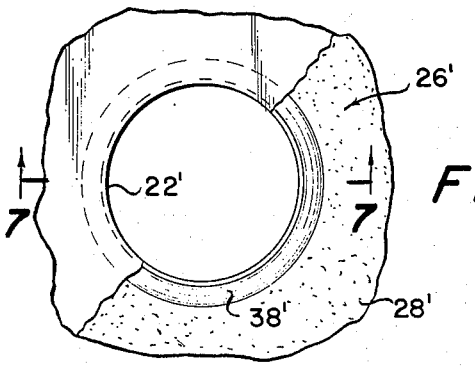
Fig. 6
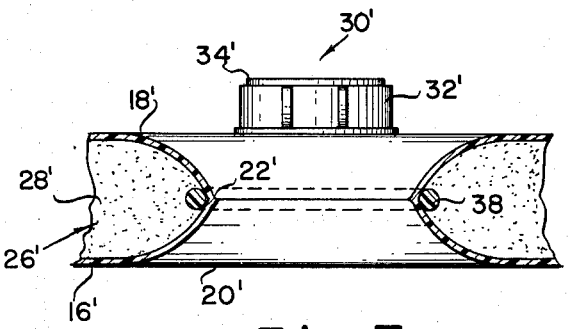
Fig. 7

WEIGHTING DEVICE FOR ATTACHMENT TO BASEBALL BATS

This application is a continuation-in-part of application Ser. No. 397,713, filed Sept. 17, 1973 (since abandoned).

BACKGROUND AND OBJECTS

It is standard procedure for baseball players to "warm-up" prior to batting by taking practice swings with the bat. It has been found that if the weight of the bat is increased during these practice swings, the unweighted bat may be swung with greater ease while batting. In the past, the bat weight has been increased by swinging to or more bats or by swinging a specially made bat permanently weighted with lead, made specifically and solely for this purpose. These practices have proven only partially satisfactory since the swinging of several bats is awkward and cumbersome and the use of a specially made bat constitutes a sizeable expenditure for an item which serves a very limited purpose.

In recent years, the use of several bats or a single weighted bat for practice swings has been largely replaced by use of a weight which is detachably engaged with the barrel of the bat by various means during the practice swings and then discarded prior to batting. One such device is disclosed in U.S. Pat. No. 3,521,883, granted July 28, 1970. The weight disclosed in that patent comprises a solid inner ring preferably made of steel or cast iron and covered by an outer ring made of rubber. While such devices have proven successful from the standpoint of weighting the bat, they are relatively expensive and there is a danger that the weight may fly off the bat during the practice swings, with resultant injury to those in the area. Additionally, in view of the solid structure of these devices, each unit is of a predetermined weight, and not adaptable for use by players of all ages and strengths.

It is an object of this invention to provide a weighting device for attachment to baseball bats which is of doughnut shape, and includes flexible wall means providing a hollow chamber which may be filled or partially filled with a liquid or granular weighting material until the desired weight is reached.

Another object is to provide a device of the character described which is of economic construction and may be detachably engaged with bats of all sizes, the device being provided with means for permitting the hollow chamber to be rapidly filled with the weighting material for use and to be quickly emptied for collapsing, to facilitate storage and transportation.

A further object is to provide a device of the character described wherein the walls thereof are constructed of a flexible material in order to permit the device to be readily engaged with the barrel of the baseball bat, and frictionally held thereby, without danger of flying off when the bat is swung, and wherein the device is shock absorbent in order to minimize injury to anyone accidentally struck thereby.

A still further object is to provide a device of the character described having means for controlling the flexing of that portion of the device engaged with the baseball bat, in order to preclude accidental disengagement thereof from the bat when the bat is swung.

DESCRIPTION OF FIGURES OF THE DRAWINGS

FIG. 1 is a plan view of the weighting device for attachment to baseball bats, illustrating its use;

FIG. 2 is a top plan view of the same;

FIG. 3 is a side elevational view of the present device in a collapsed or unfilled condition;

FIG. 4 is an enlarged sectional view taken along the line 4—4 of FIG. 1, looking in the direction of the arrows, a portion thereof being broken away to disclose details of construction;

FIG. 5 is a sectional view taken along the line 5—5 of FIG. 4, looking in the direction of the arrows;

FIG. 6 is a fragmentary view similar to FIG. 4, illustrating a modified form of the present invention and, FIG. 7 is a sectional view taken along the line 7—7 of FIG. 6, looking in the direction of the arrows.

DESCRIPTION OF THE FORM OF INVENTION ILLUSTRATED IN FIGS. 1 TO 5

The present invention generally comprises a doughnut-shaped weighting device for frictional engagement with a barrel of the baseball bat, in order to increase the weight of the bat during practice swings prior to batting. The device includes wall means of flexible material forming a closed, hollow chamber to which liquid or granular materials are added in any desired amount through suitable valve means. The weighting material may be added to the chamber in any desired amount, and is readily removed therefrom to permit collapsing for storage and transportation. A reinforcing member proximate the central opening of the doughnut-shaped device limits the flexing of the walls proximate the opening in order to obviate accidental disengagement thereof from the bat when it is swung.

Referring now in greater detail to the drawings, there is illustrated in FIG. 1 a baseball player holding a standard bat 10 which includes a barrel portion 12 and a handle portion 14. The weighting device of the present invention is indicated at 16 and comprises a doughnut-shaped hollow member which is adapted to be passed over the handle portion of the bat into frictional engagement with barrel 12.

Referring now to FIGS. 4 and 5, member 16 includes like, annular, upper and lower wall portions 18 and 20 respectively, the central portion of each of which is cut out to provide an opening of predetermined size for proper fitting over the bat. Walls 18 and 20 are of flexible material, polyvinyl chloride and nylon having been found to be very satisfactory. The inner and outer edges of walls 18 and 20 are preferably thermo-dielectrically joined together as indicated at 22 and 24, but may be also secured in any other suitable manner. This provides a closed, hollow annular chamber 26 into which a weighting material 28 is placed. This weighting material may be of a liquid such as water, but a granular material, preferably sand, has been found preferable in view of its greater weight. Admission of the weighting material to chamber 26 is effected by means of a conventional valve 30. A Roberts valve such as constructed in accordance with U.S. Pat. No. 2,777,490 has been found to be suitable for this purpose. This valve includes an annular body 32 which extends through top wall 18, the central opening of the body being selectively closed by a closure element 34.

In order to control the stretching of the flexible material of walls 18 and 20 in the area of their connection at 22, there is provided a stiffening member 36 which, as shown in FIGS. 4 and 5 is located internally of chamber 26. Member 36 is of annular shape and is preferably of rigid or semi-rigid construction. When polyvinyl chloride is employed for walls 18 and 20, it is preferable that member 36 also be of polyvinyl chloride but be of stiffer consistency than the walls in order to control stretching of the walls adjacent the central opening. Member 36 may then be so arranged that the inner periphery thereof extends between the inner peripheral edges of walls 18 and 20 and is dielectrically sealed therewith. The central bore of the present device is indicated at 38.

In use of the present invention, the device is shipped and stored in its collapsed or flat state illustrated in FIG. 3. When it is desired to use the device, closure element 34 is disengaged from body 32 and liquid or granular weighting material is poured through body 32 into chamber 26 until the device is weighted to the desired extent. Just how much weight is added to the chamber will depend upon the age and strength of the players employing the device.

In applying the weighting device to a bat, bore 38 thereof is centered over the bat handle end of the bat and the device is held at a slight angle thereto. The device is then pressed over the knob of the bat and slid downwardly passed the handle into frictional engagement with the barrel of the bat. The bat may then be swung freely without danger of the device flying off the barrel end of the bat. When it is desired to remove the weighting device from the bat, the handle end thereof may be tapped on the ground while the bat is in a vertical position, to loosen the frictional engagement of the device with the barrel of the bat, and permit the same to gravitate downwardly past the handle of the bat to the ground.

DESCRIPTION OF THE FORM OF INVENTION ILLUSTRATED IN FIGS. 6 AND 7

In FIGS. 6 and 7 there is illustrated a modified form of the present invention. The basic construction of this form of the invention is the same as illustrated in FIGS. 1 to 5 and accordingly, like parts are identified by like, primed numerals. In this form of the invention, however, the stiffening member for controlling flexing of flexible walls 18 and 20 comprises a ring 38 which may be of plastic or metallic construction, and is of a size to remain in position within the chamber adjacent joint 22′ without being secured to the walls. There is thereby provided a simple but effective means of controlling stretching of the walls, thereby obviating accidental disengagement of the device with the barrel of the baseball bat during practice swings.

By virtue of the materials and construction of the weighting device of the present invention, it may be economically made, while at the same time, afford a maximum safety during use. The construction of the device of a flexible material containing liquid or granules additionally affords shock absorbing materials in the event that anyone is struck thereby while the bat is being swung.

The filling and emptying of the device enables the weight thereof to be varied considerably depending upon the users thereof, and at the same time allows the complete emptying thereof so that the weighting device may be reduced to a substantially flat state for storage and transportation, and also facilitating shipment of the devices in quantity.

The weighting device is so constructed that it may be filled to any desired weight from a few ounces to a few pounds and fits all bat sizes. Although constructed of a flexible material, when it is filled or partially filled, the unit will support itself without collapsing and is so constructed that it will not rupture when undue pressure is exerted thereon.

While there has been herein shown and described the presently preferred form of this invention, it is to be understood that such has been done for purposes of illustration only, and that various changes may be made therein within the scope of the appended claims.

What I claim is:

1. A weighting device for attachment to a conventional baseball bats including:
   a. a collapsible member of substantially doughnut shape having a bore, the size of which permits the handle portion of the bat to be passed through the bore while effecting frictional engagement of the portion of the member defining the bore with the barrel portion of the bat, for preventing relative longitudinal movement of said member with respect to the bat, when the latter is swung,
   b. said collapsible member comprising a pair of like, opposed, annular walls of flexible sheet material,
   c. means for sealing together the inner edges and outer edges respectively of said walls to provide an annular chamber therebetween,
   d. a substantially rigid stiffener of annular shape fixed to said collapsible member proximate the bore thereof for controlling the stretching of said walls when engaged with a baseball bat,
   e. weighting substance, and
   f. valve means in one of said walls for admitting said weighting substance to the annular chamber for use of the device, and to permit removal of said weighting substance therefrom, for collapsing the member.

2. The weighting device of claim 1, wherein:
   a. said substantially rigid stiffener is within the annular chamber at the point where the inner edges of said walls are sealed together.

3. The weighting device of claim 2, wherein:
   a. the inner periphery of said substantially rigid stiffener extends between the inner peripheral edges of said walls and is secured thereto.

4. The weighting device of claim 2, wherein:
   a. said substantially rigid stiffener comprises a ring positioned within said annular chamber adjacent the joint where the inner edges of said walls are sealed together.

5. The weighting device of claim 1, wherein:
   a. said weighting substance is granular material.

6. The weighting device of claim 1, wherein:
   a. said weighting substance is sand.

7. The weighting device of claim 1, wherein:
   a. said weighting substance is liquid.

8. The weighting substance of claim 7, wherein:
   a. said weighting substance is water.

9. The weighting device of claim 1, wherein:
   a. said walls are made of polyvinyl chloride.

10. The weighting device of claim 1, wherein:
   a. said walls are made of nylon.

11. A weighting device for attachment to a conventional baseball bats including:
   a. a collapsible member of substantially doughnut shape providing a bore the size of which permits the handle portion of the bat to be passed through the bore while effecting frictional engagement of the portion of the member defining the bore with the barrel portion of the bat, for preventing relative longitudinal movement of said member with respect to the bat, when the latter is swung, b. said collapsible member comprising a pair of like opposed annular walls of flexible polyvinyl chloride material, c. means for sealing together the inner edges and outer edges respectively of said walls to provide a closed annular chamber therebetween, d. a substantially rigid stiffener of annular shape, the inner periphery of which extends between the inner peripheral edges of said walls and is secured thereto.

e. said stiffener being made of polyvinyl chloride material which is of stiffer consistency than said walls in order to control stretching of the portion of said walls adjacent the bore of the collapsible member, f. sand, and g. valve means in one of said walls for admitting said sand to the closed annular chamber for use of the device, and to permit removal of the sand therefrom, for collapsing the member.

* * * * *